US006773144B2

(12) United States Patent
Lu

(10) Patent No.: US 6,773,144 B2
(45) Date of Patent: Aug. 10, 2004

(54) COLLAPSIBLE LAMP SHADE STRUCTURE

(76) Inventor: King Long Lu, PO Box 82-144, Taipei (TW)

( * ) Notice: Subject to any disclaimer, the term of this patent is extended or adjusted under 35 U.S.C. 154(b) by 0 days.

(21) Appl. No.: 10/224,462

(22) Filed: Aug. 21, 2002

(65) Prior Publication Data

US 2003/0198053 A1 Oct. 23, 2003

(30) Foreign Application Priority Data

Apr. 18, 2002 (TW) ..... 91205184 U

(51) Int. Cl.[7] ..... F21V 1/06
(52) U.S. Cl. ..... 362/352; 362/452; 362/358
(58) Field of Search ..... 362/352, 450, 362/452, 351, 358, 410

(56) References Cited

U.S. PATENT DOCUMENTS 4,354,222 A * 10/1982 Gall ..... 362/352
6,315,434 B1 * 11/2001 Long ..... 362/352
6,517,220 B2 * 2/2003 Wu ..... 362/352
6,582,107 B2 * 6/2003 Tsai ..... 362/450
6,604,846 B2 * 8/2003 Strickland ..... 362/352

FOREIGN PATENT DOCUMENTS

FR 2608255 A1 * 6/1988

* cited by examiner

*Primary Examiner*—Thomas M. Sember
*Assistant Examiner*—Hargobind S. Sawhney
(74) *Attorney, Agent, or Firm*—Leong C. Lei

(57) ABSTRACT

A collapsible lampshade structure includes an upper fixing ring provided with a plurality of engaging members, a lower fixing ring provided with a plurality of engaging seats, and a plurality of ribs each having a projection at an upper end thereof and two pins at a lower end thereof, the ribs being detachably connected between the engaging members of the upper fixing ring and the engaging seats of the lower fixing rings, whereby when in disassembly, upper ends of the ribs are detached from the upper fixing ring enable the upper fixing ring and the ribs to collapse on the lower fixing ring thereby facilitating its transporting, and making it easier for packaging purposes.

2 Claims, 3 Drawing Sheets

COLLAPSIBLE LAMP SHADE STRUCTURE

BACKGROUND OF THE INVENTION

1. Field of the Invention

This invention is related to a collapsible lamp shade structure and in particular to one comprising an upper fixing ring, a lower fixing ring, and a plurality of ribs which can be easily assembled to form a lamp shade and dismantled to reduce its volume, thereby facilitating its transporting, and making it easier for packaging purposes.

2. Description of the Prior Art

The conventional lamp shade is composed of an upper fixing ring, a lower fixing ring, and a plurality of ribs which are welded between the upper and the lower fixing rings, and a cloth hood which is mounted on the outside of the frame and a lining is mounted inside the frame. However, this kind of lampshade cannot be dismantled or collapsed, and so it is bulky in volume, making it difficult for packaging and difficult for transportation. Therefore it is an object of the present invention to provide an improved lampshade structure which can obviate and mitigate the above-mentioned drawbacks.

SUMMARY OF THE INVENTION

This invention is related to a collapsible lamp shade structure comprising an upper fixing ring, a lower fixing ring, and a plurality of ribs which can be easily assembled to form a lamp shade and dismantled to reduce its volume.

According to a preferred embodiment, a collapsible lampshade structure includes an upper fixing ring provided with a plurality of engaging members, a lower fixing ring provided with a plurality of engaging seats, and a plurality of ribs each having a projection at an upper end thereof and two pins at a lower end thereof, the ribs being detachably connected between the engaging members of the upper fixing ring and the engaging seats of the lower fixing rings, whereby when in disassembly, upper ends of the ribs are detached from the upper fixing ring enable the upper fixing ring and the ribs to collapse on the lower fixing ring thereby facilitating its transporting, and making it easier for packaging purposes.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
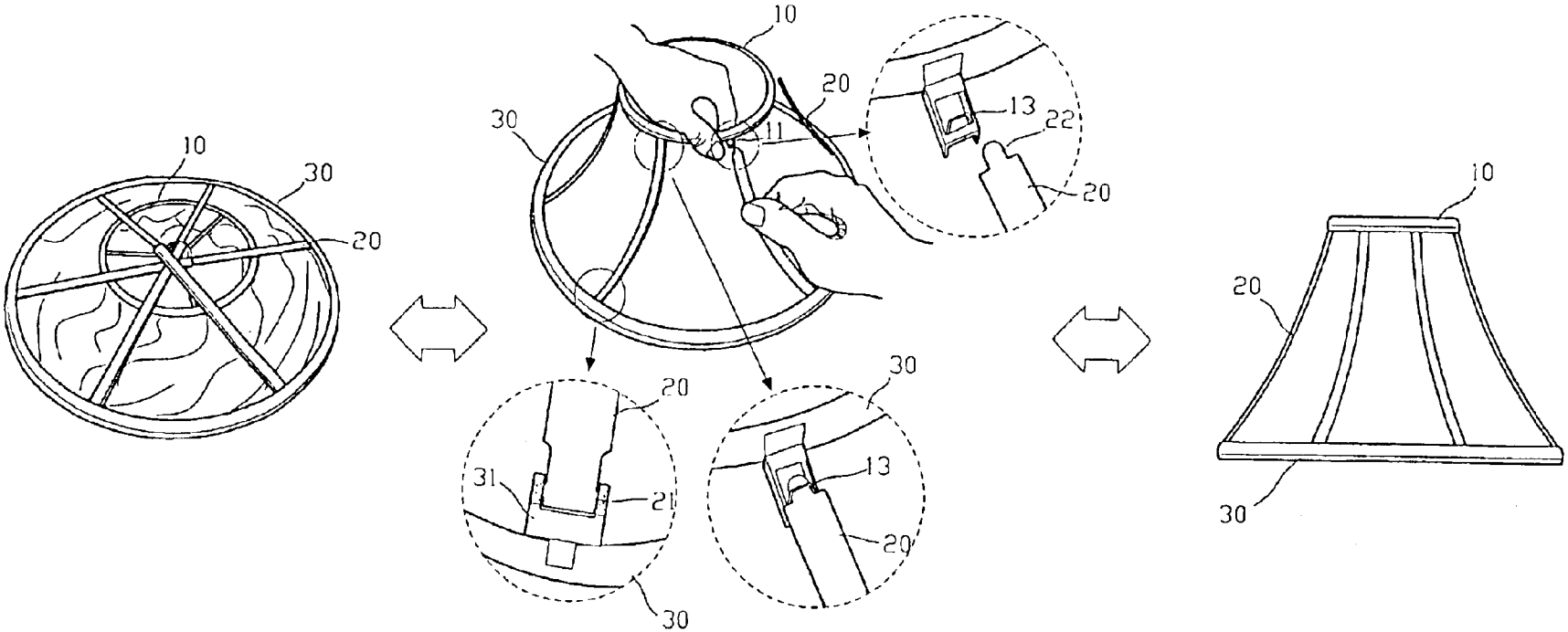
FIG. 1 illustrates the procedures to assemble the improved lampshade according to the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

With reference to FIGS. 1, 3A, 3C and 3D, the improved lampshade structure according to the present invention comprises an upper fixing ring 10, a lower fixing ring 30, and a plurality of ribs 20. The lower fixing ring 30 is larger than the upper fixing ring 20 in diameter. The upper fixing ring 10 is provided with a plurality of engaging members 11, which are inverted U-shaped members each formed with a trapezoid outwardly extending lug 13 having a hole. The lower fixing ring 30 is provided with a plurality of engaging seats 31, each having two side flanges 32 each having a hole 33 for receiving a pin 21 provided at an upper end of the rib 20. The other end of the rib 20 has a projection 22 adapted to engage with the hole of the trapezoid lug 13 of the engaging member 11.

When in assembly, the ribs 20 are mounted between the upper fixing ring 10 and the lower fixing ring 30, so that the projection 22 of the ribs 20 is engaged with the hole of the trapezoid lug 13, while the pins 21 at the other end of the rib are engaged with the engaging seat 31. Then, the cloth hood and the inner lining are mounted on the outer and inner side of the lampshade structure by any suitable known means.

When in this assembly, it is only necessary to apply force to length of the rib 20 so as to make the projection 22 to disengage from the hole of the trapezoid lug 13 of the engaging member 11 and then the ribs 20 may be collapsed together with the cloth hood to form a flat shape, so that the volume of the lamp shades can be reduced, thereby facilitating packaging and transportation.

Figure 2:
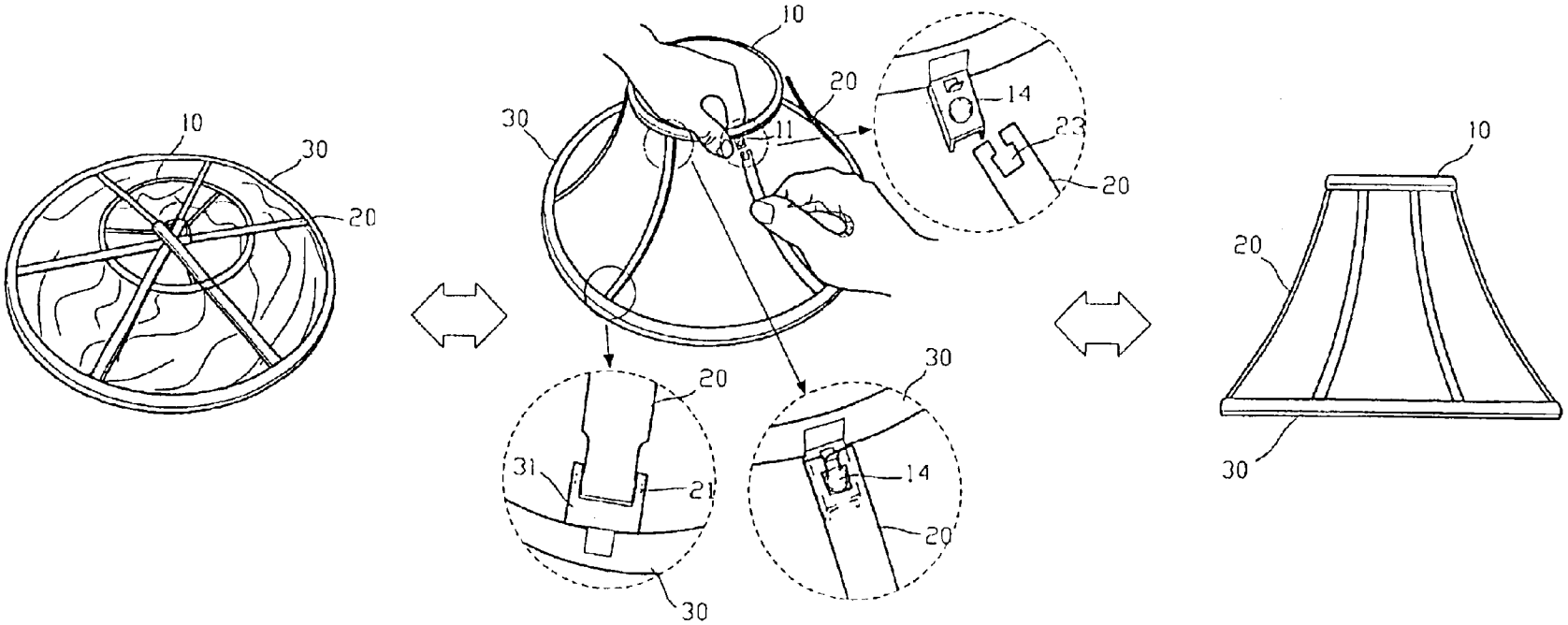
FIG. 2 illustrates the procedure to assemble a second preferred embodiment of the present invention.
Figure 3C:
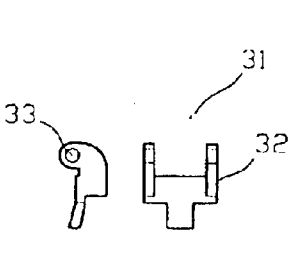
FIG. 3C illustrates two different views of the engaging seat.
Figures 3A, 3B:
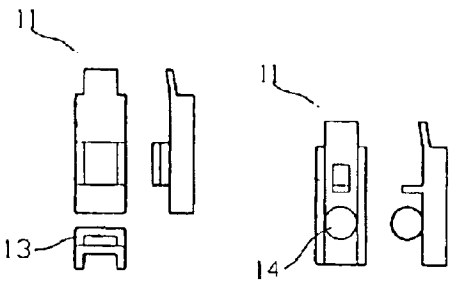
FIG. 3A illustrates three different views of the engaging member.
FIG. 3B illustrates two different views of another preferred embodiment of the engaging member.
Figures 3D, 3E:
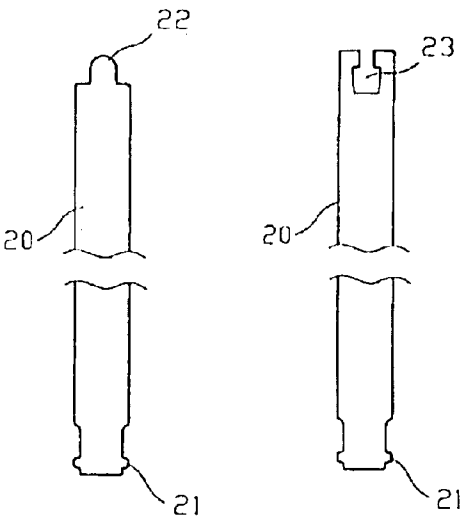
FIG. 3D illustrates the structure of the rib.
FIG. 3E illustrates the structure of another preferred embodiment of the rib.

FIGS. 2, 3B and 3E illustrate a second preferred embodiment of the present invention. As shown, the engaging member 11 of the upper fixing ring 10 is provided with a ball-shaped element 14. The upper end of the rib 20 has a recess, which is narrow at the entrance, and the inner portion is dimensioned to receive the ball-shaped element 14.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A collapsible lampshade structure comprising:

an upper fixing ring including a plurality of engaging members each provided with a ball-shaped element;

a lower fixing ring provided with a plurality of engaging seats; and a plurality of ribs each having a projection at an upper end thereof and two pins at a lower end thereof, said ribs being detachably connected between said engaging members of said upper fixing ring and said engaging seats of said lower fixing rings;

whereby when in disassembly, upper ends of said ribs are detached from said upper fixing ring thereby enabling said upper fixing ring and said ribs to collapse on said lower fixing ring.

2. The collapsible lampshade structure as claimed in claim 1, wherein said rib has an end formed with a recess dimensioned to engage with said ball-shaped element.

* * * * *